US011511958B2

(12) United States Patent
Montano

(10) Patent No.: US 11,511,958 B2
(45) Date of Patent: Nov. 29, 2022

(54) WIRE MESH DISPENSER

(71) Applicant: Roque B. Montano, Tucson, AZ (US)

(72) Inventor: Roque B. Montano, Tucson, AZ (US)

( * ) Notice: Subject to any disclaimer, the term of this patent is extended or adjusted under 35 U.S.C. 154(b) by 405 days.

(21) Appl. No.: 16/833,646

(22) Filed: Mar. 29, 2020

(65) Prior Publication Data

US 2021/0300705 A1 Sep. 30, 2021

(51) Int. Cl.

| | |
|---|---|
| ***E04G 21/16*** | (2006.01) |
| ***E04H 17/26*** | (2006.01) |
| ***B65H 16/00*** | (2006.01) |
| ***B65H 16/04*** | (2006.01) |

(52) U.S. Cl.

CPC ..... *B65H 16/005* (2013.01); *B65H 16/04* (2013.01); *E04G 21/16* (2013.01); *E04H 17/266* (2013.01); *B65H 2401/15* (2013.01); *B65H 2402/33* (2013.01); *B65H 2402/35* (2013.01); *B65H 2403/941* (2013.01); *B65H 2404/167* (2013.01); *B65H 2701/3912* (2013.01)

(58) Field of Classification Search

CPC ..... E04H 17/261; E04H 17/266; E04G 21/16; E04G 21/169; B65H 16/04; B65H 2402/33; B65H 2403/941; B65H 2701/3912

See application file for complete search history.

(56) References Cited

U.S. PATENT DOCUMENTS

| | | | | |
|---|---|---|---|---|
| 2,914,270 | A * | 11/1959 | Parker | B65H 49/32 242/399.1 |
| 3,048,348 | A * | 8/1962 | Griffin | B65H 49/32 242/598 |
| 5,163,634 | A * | 11/1992 | Moon | E04H 17/266 242/598.5 |
| 2005/0133776 | A1* | 6/2005 | Capps | E04H 17/266 256/32 |
| 2021/0140195 | A1* | 5/2021 | Taylor | E04H 17/266 |
| 2021/0293051 | A1* | 9/2021 | Miller, Sr. | B60P 3/00 |

FOREIGN PATENT DOCUMENTS

| | | | | |
|---|---|---|---|---|
| FR | 2734803 | A1 * | 12/1996 | B65H 75/403 |
| FR | 2861064 | A1 * | 4/2005 | B62B 1/264 |

* cited by examiner

*Primary Examiner* — Christine T Cajilig
(74) *Attorney, Agent, or Firm* — Eugene Vamos

(57) ABSTRACT

A wire mesh dispenser (99) allowing for the transportation, unrolling and deployment of wire mesh (91) is described. This wire mesh dispenser (99) is light weight, low profile, easily reloadable, and capable of being utilized with one arm. The wire mesh dispenser (99) allows an individual to unroll wire mesh (91) from a wire mesh roll (90) in tight, hard to reach spaces such as corners, narrow alleyways, and high reach areas. The wire mesh dispenser (99) is especially suited for the preparation of stucco based structures in construction projects. The wire mesh dispenser (99) comprises of an upper structure (100), a lower structure (200), and a means to fasten shafts (400).

18 Claims, 9 Drawing Sheets

WIRE MESH DISPENSER

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

REFERENCE TO A "SEQUENCE LISTING,"A TABLE, OR A COMPUTER PROGRAM

Not Applicable

STATEMENT REGARDING PRIOR DISCLOSURES BY AN INVENTOR OR JOINT INVENTOR

Not Applicable

BACKGROUND OF THE INVENTION (1) Field of Invention

The present invention generally relates to the field of wire mesh dispensers.

(2) Description of Related Art

Wire mesh is thin flexible metal wire that is welded or woven into lattice patterns. This wire mesh is an extremely versatile product that can be used for a number of applications, including animal containment, temporary fences, home maintenance, and craft projects. It provides great protection and support for plants, erosion control, and compost containment. Wire mesh is an economical solution that is easy to install and alter to meet customer needs. Two examples of wire mesh are chicken wire and hardware cloth.

Chicken wire, or poultry netting, is made of thin, flexible, metal wire—usually galvanized steel—with hexagonal gaps, weaved into a mesh. Available in I/2 inch (about 1.3 cm), 1 inch (about 2.5 cm) diameter and 2 inch diameter (about 5 cm), chicken wire is available in various gauges—usually 19 gauge (about 1 mm wire) to 22 gauge (about 0.7 mm wire). Chicken wire is utilized in many applications. It is traditionally used to build inexpensive pens, such as runs or coops, for small animals such as fowl, or to protect plants and property from animals.

Hardware cloth features steel wire typically arranged into a square mesh weave that is usually welded together. Hardware cloth is both lightweight and durable and typically features ½ inch and 1 inch mesh spacing.

In construction, chicken wire and hardware cloth are used as a metal lath to hold cement or plaster, a process known as stuccoing. Concrete reinforced with chicken wire or hardware cloth yields ferrocement, a versatile construction material. It can also be used to make the armature for a papier-mâché sculpture, when relatively high strength is needed.

(3) Technical Problems

Wire mesh (91) is manufactured and sold in rolls (90), usually in 50 feet, 100 feet and 150 feet lengths. To utilize the wire mesh (91), it is typically unwound manually from the roll (90). The size and weight of the wire mesh roll (90), combined with the inherent nature of the wire mesh roll (90) to unwind, makes wire mesh (91) handling quite burdensome. This is especially the case where wire mesh (91) is deployed beyond arm's length height such as when applying stucco on the walls of upper floors. For example, when individuals unroll and deploy wire mesh (91) in construction, it leaves them physically drained by the constant lifting, pulling, and tugging. Furthermore, the wire mesh's jagged edges easily tear into flesh, leaving the individual with deep scratch wounds. The jagged edges also damage clothing, ripping pants and tearing boots.

No devices exist that can help individuals unroll and deploy wire mesh (91). An analogous field relates to devices that unwind wire fencing; various devices have been developed to deploy wire fencing. However, these devices are designed so that the wire fencing deployment is ground based. Generally, these devices can be classified as push carts, tractor pulls, tractor attachment and scissor lift attachments.

(3).1 Push Carts

Push carts are the simplest devices used to unwind and unspool wire fencing. These push carts have wheeled elements that allow an individual to provide forward motion that unspools the wire fencing. However, these devices are only designed to be rolled over the ground.

Prior Art utilizing push carts to unspool wire fencing include:

U.S. Pat. No. 7,464,809 BI Mobile Wire Dispensing Apparatus

US 2003/0080236 AI Rolled Wire Net and Fence Dispensing Apparatus

US 2005/0150991 AI Fence Wire Spool Decoiler (3).2 Tractor Pulls

Wire fencing unspooling can be accomplished by devices that are placed over a wheeled platform providing mechanical support and then pulled by a tractor or a pick up truck to provide mobility that unspools the wire fencing. Their design and size do not allow an individual to utilize these devices; the devices rely on a separate element to enable mobility.

Prior Art utilizing tractor pulls to unspool wire fencing include:

U.S. Pat. No. 337,119 Machine for Building Wire Fences

U.S. Pat. No. 3,934,655 Hydraulic Post Setting and Wire Dispensing Apparatus

U.S. Pat. No. 4,775,114 Fencing Wire Unwinder and Tensioner (3).3 Tractor Attachments Wire fencing unspooling can be accomplished by devices that are connected directly to a truck or tractor. The truck or tractor provides mechanical support and mobility that unspools the wire fencing. Their design and size does not allow an individual to utilize these devices and relies on a separate element to provide mechanical support and mobility.

U.S. Pat. No. 3,048,348 Wire Fencing Stringing and Stretching Implement

U.S. Pat. No. 5,163,634 Fence Stretching Apparatus

U.S. Pat. No. 5,582,216 Apparatus and Method for Installing Wire Fencing (3).4 Scissor Lifts Attachment Wire fencing unspooling can be accomplished by a device that is connected to a planar crane, as described in U.S. Pat. No. 10,246,283 Vertical Wall Webbing Installation Method and System. However, wire mesh unspooling is limited to the places where a planar crane can be deployed a flat surface with ample space to move the planar crane, with a second person or a mobility source needed to move the planar crane.

(4) Solution Approaches

These prior art devices are not adapted to be used by an individual in tight or high reach spaces to unspool wire mesh (91). These prior art devices are heavy, bulky, are cumbersome to reload, and require, for the most part, a mobility source. A need exists for a device that is light weight, low profile, easily reloaded, and capable of being utilized with one arm. These features would allow an individual to unspool wire mesh in tight, hard to reach spaces such as corners, narrow alleyways, and high reach areas.

DEFINITIONS

A major are—an arc of a circle having measure greater than or equal to 180 degrees.

BRIEF SUMMARY OF THE INVENTION

A wire mesh dispenser (99) allowing for the transportation, unrolling, and deployment of wire mesh (91) is described. This wire mesh dispenser (99) is light weight, low profile, easily reloadable, and capable of being utilized with one arm. The wire mesh dispenser (99) allows an individual to unroll wire mesh (91) from a wire mesh roll (90) in tight, hard to reach spaces such as corners, narrow alleyways, and high reach areas. The wire mesh dispenser (99) is especially suited for the preparation of stucco based structures in construction projects.

The wire mesh dispenser (99) comprises of an upper structure (100), a lower structure (200), and a means to fasten shafts (400). The upper structure (100) comprises of an upper structure handle (110), an upper shaft (120), a horizontal segment (136), two vertical segments (130)—a first vertical segment (132) and a second vertical segment (134)—an open shape segment (140), and two roller handles (150)—a first roller handle (160), and a second roller handle (170). The lower structure (200) comprises of a lower shaft (210) and a base (220). The upper shaft (120) of the upper structure (100) is fastened to the lower shaft (210) of the lower structure (200) by a means to fasten shafts (400). FIG. 3 shows a perspective view of the wire mesh dispenser (99), with the upper structure (100) and the lower structure (200) fastened together with a means to fasten shafts (400).

DETAILED DESCRIPTION OF THE INVENTION

Figure 1:
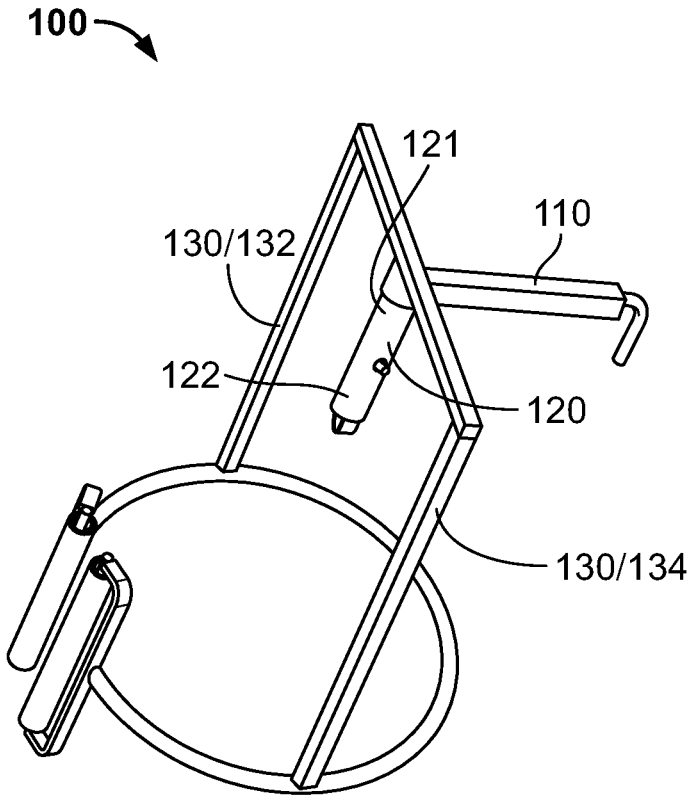
FIG. 1 shows a perspective view of the upper structure (100).

A wire mesh dispenser (99) allowing for the transportation, unrolling, and deployment of wire mesh (91) by a single individual is described. This wire mesh dispenser (99) is light weight, low profile, easily reloadable, and capable of being utilized with one arm. The wire mesh dispenser (99) allows an individual to unroll wire mesh in tight, hard to reach spaces such as corners, narrow alleyways, and high reach areas. The wire mesh dispenser (99) is especially suited for the preparation of stucco based structures in construction projects. A wire mesh roll (90) is created by rolling wire mesh (91) around a central axis, normally creating a cylindrical central void (92), an upper hole (93), and a lower hole (94)

The wire mesh dispenser (99) comprises of an upper structure (100), a lower structure (200), and a means to fasten shafts (400).

The upper structure (100) comprises of an upper structure handle (110)), an upper shaft (120), a horizontal segment (136), two vertical segments (130) a first vertical segment (132) and a second vertical segment (134) an open shape segment (140), and two roller handles (150) a first roller handle (160), and a second roller handle (170).

The lower structure (200) comprises of a lower shaft (210) and a base (220).

Figure 3:
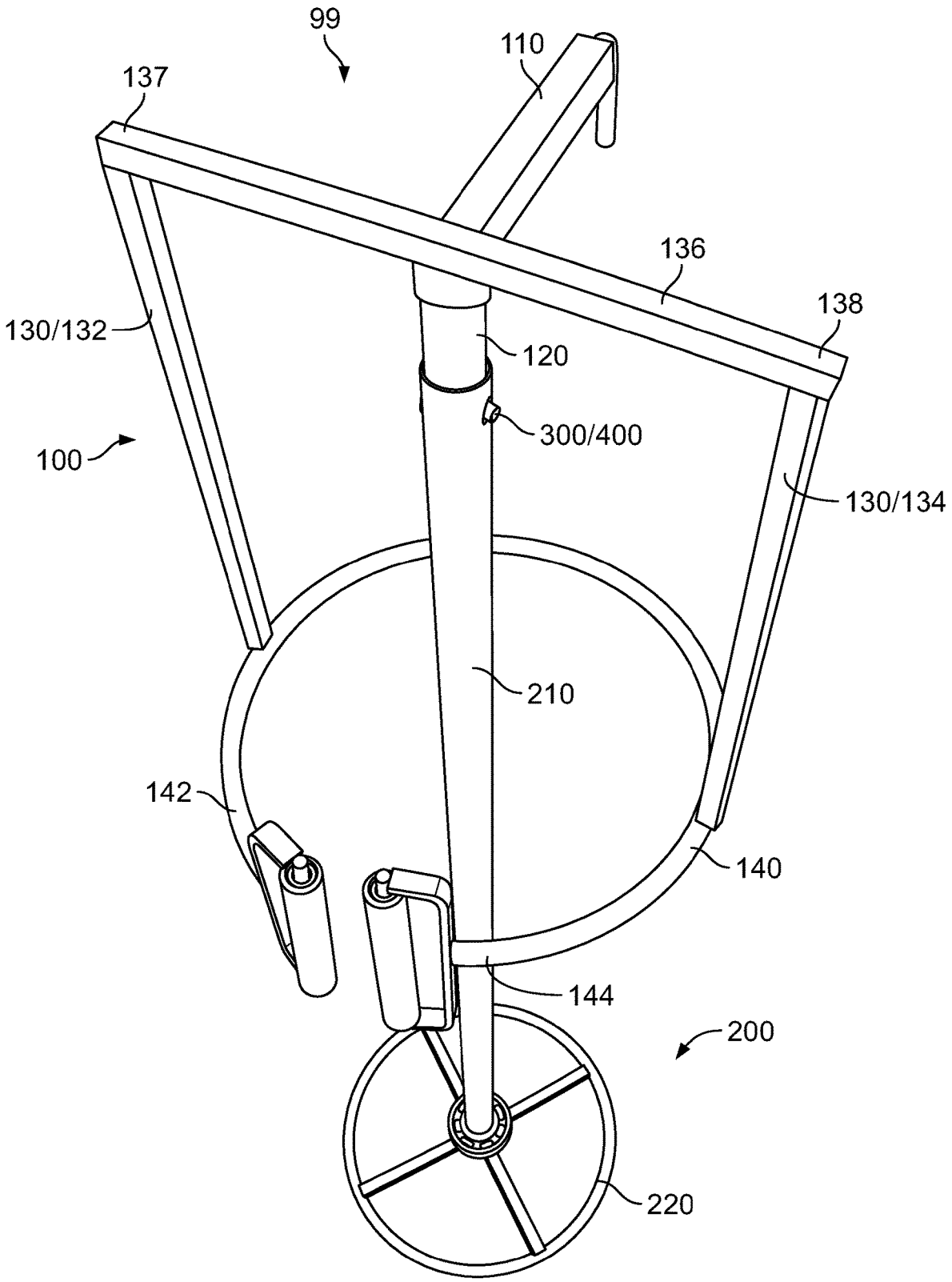
FIG. 3 shows a perspective view of the wire mesh dispenser (99), with the upper structure (100) and the lower structure (200) fastened together with a means to fasten shafts 400).

The upper shaft (120) of the upper structure (100) is fastened to the lower shaft (210) of the lower structure (200) by a means to fasten shafts (400). FIG. 3 shows a perspective view of the wire mesh dispenser (99), with the upper structure (100) and the lower structure (200) fastened together with a means to fasten shafts (400).

(1) Upper Structure (100)

The upper structure (100 comprises of an upper structure handle (110)), an upper shaft (120), a horizontal segment (136), two vertical segments (130) a first vertical segment (132) and a second vertical segment (134) an open shape segment (140), and two roller handles (150) a first roller handle (160), and a second roller handle (170). FIG. 1 shows a perspective view of the upper structure (100).

The upper structure handle (110)) is connected to the horizontal segment (136). The user grabs the upper structure handle (110)) and uses it to move the wire mesh dispenser (99) along a structure as the wire mesh dispenser (99) unrolls the wire mesh roll (90).

The upper shaft (120) is used to secure the upper end of the wire mesh roll (90). The upper shaft (120) comprises of an upper end (121), and a lower end (122). The upper shaft (120) can either be solid or be hollow. When the upper shaft (120) is hollow, the upper shaft (120) further comprises a bore (123).

The upper end (121) of the upper shaft (120) is connected to the horizontal segment (136). The horizontal segment (136) has a first end (137) and a second end (138). Two vertical segments (130) are connected to the horizontal segment (136); a first vertical segment (132) is connected to the first end (137) of the horizontal segment (136) and a second vertical segment (134) is connected to the second end (138) of the horizontal segment (136).

An open shape segment (140) is connected to the first vertical segment (132) and to the second vertical segment (134). The open shape segment (140) comprises of a first end (142), a second end (144), and a gap (102). The open shape segment (140) provides support to the wire mesh roll (90). An open shape is defined as a shape whose line segments and/or curves do not start and end at the same point. The gap (102) is created between the first end (142) and the second end (144) of the open shape segment (140). Any shape may be used for the open shape segment (140) such as square, triangular, or hexagonal, but preferentially a circular shape may be used, such as a major arc shape. A circular shape mirrors the shape of the wire mesh roll (90) and better enables the deployment of the wire mesh roll (90).

Figure 4:
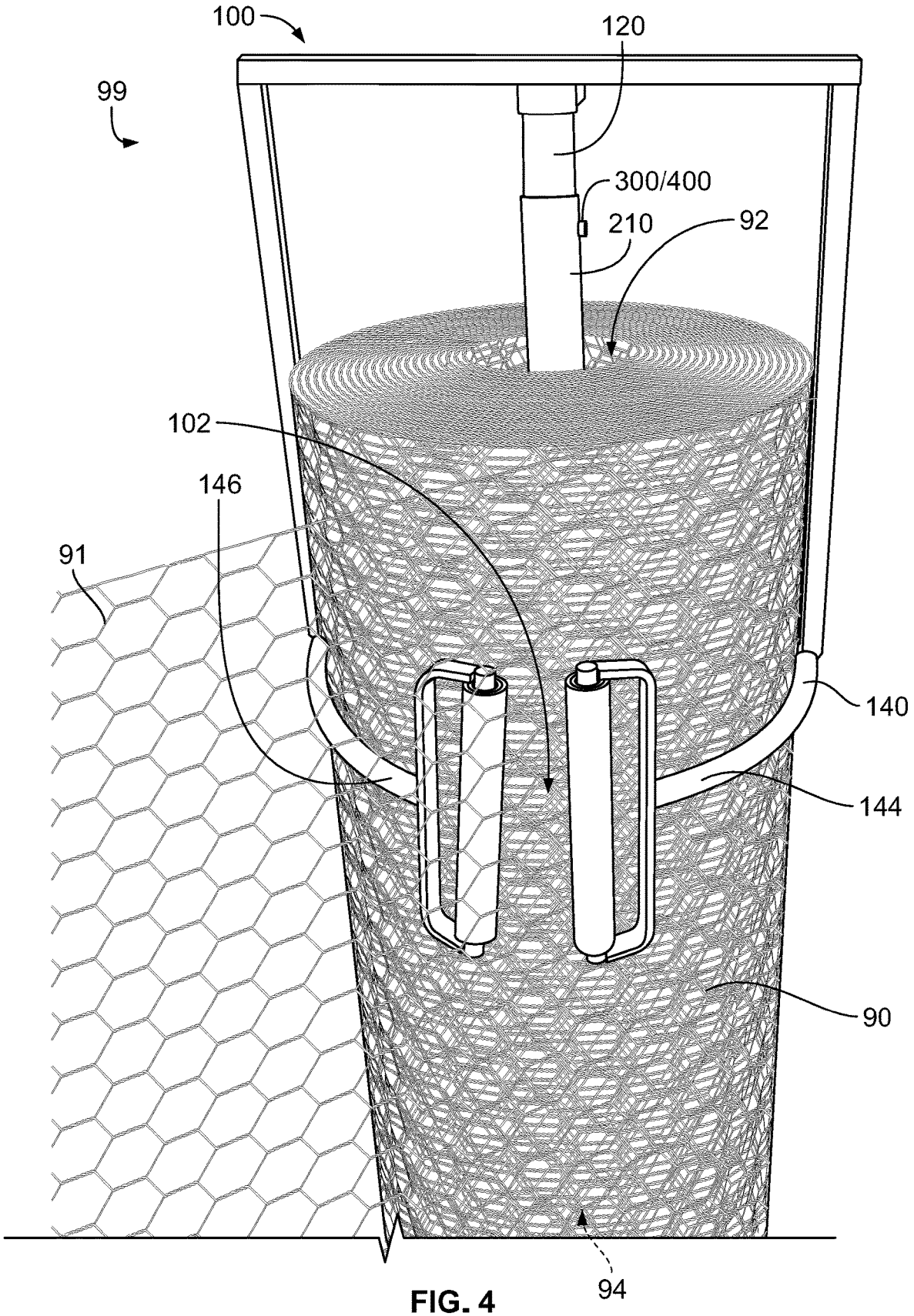
FIG. 4 shows a perspective view of the wire mesh dispenser (99), with a wire mesh roll (90) inserted within the upper structure (100) and the lower structure (200), showing the wire mesh (91) of the wire mesh roll (90) being guided through the gap (102) of the open shape segment (140) in the shape of a major arc.
Figure 5:
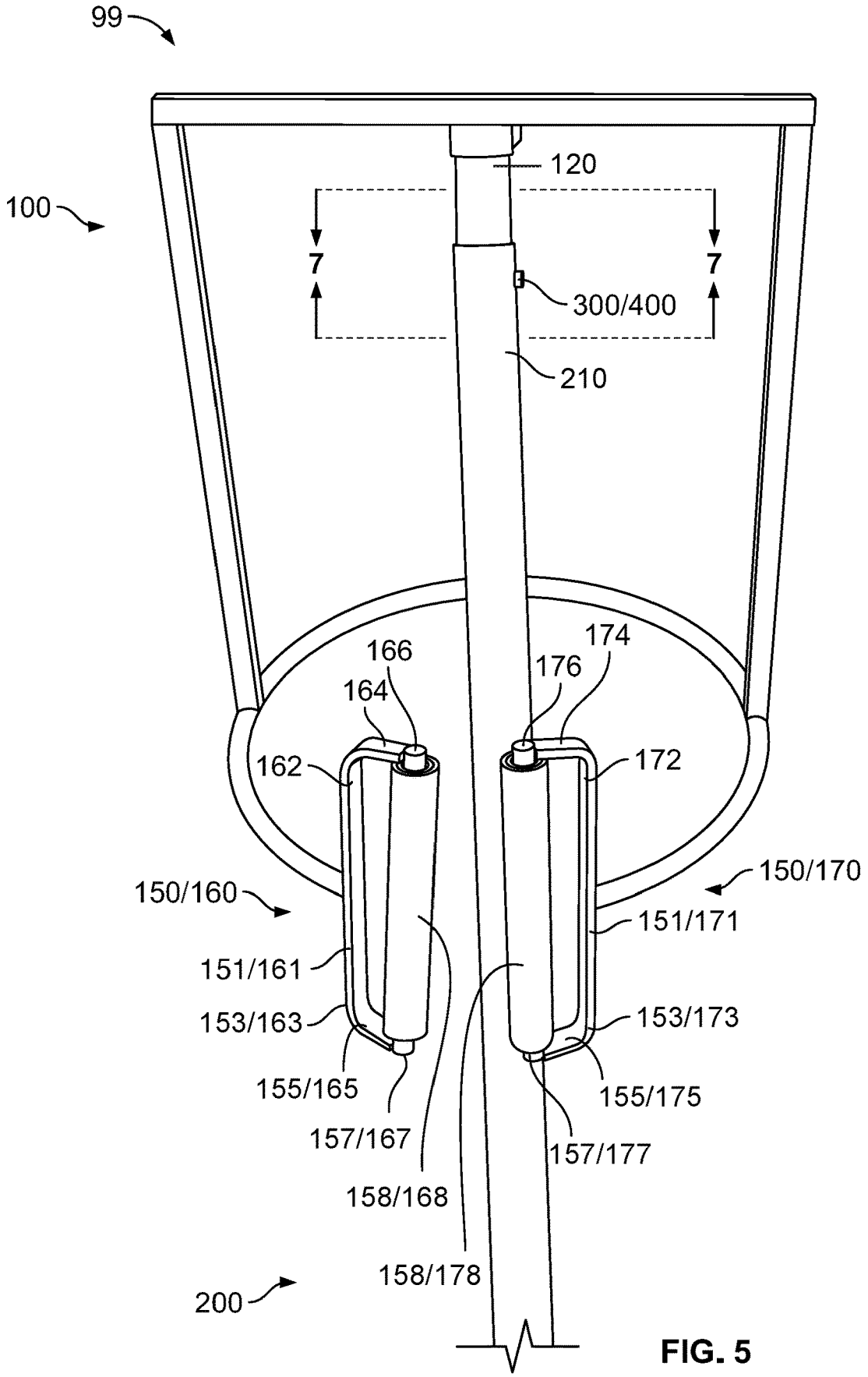
FIG. 5 shows a perspective view of the wire mesh dispenser (99), showing the first roller handle (160) and the second roller handle (170) of the the upper structure (100) facing each other.

The open shape segment (140) may be manufactured in a range of sizes to accommodate different wire mesh roll (90) sizes. A standard sized chicken wire roll of 17 gauge wire is typically 10.5 inches in diameter; a bigger chicken wire roll of 20 gauge wire is usually 13.5 inches in diameter. When the open shape segment (140) is a circular shape, the diameter of the circular shape may be varied. For example, when the wire mesh roll (90) is 10.5 inches in diameter, the open shape segment (140) may be 12 inches in diameter; when the wire mesh roll (90) is 13.5 inches in diameter, the open shape segment (140) may be 13.75 inches in diameter A roller handle (150) is connected to each of the ends of the open shape segment (140). A first roller handle (160) is connected to the first end (142) of the open shape segment (140); a second roller handle (170) is connected to the second end (144) of the open shape segment (140). The first roller handle (160) and the second roller handle (170) face each other within the gap (102), guiding the wire mesh (91) from the wire mesh dispenser (99) as the wire mesh roll (90) is unwound. FIG. 5 shows a perspective view of the wire mesh dispenser (99), showing the first roller handle (160) and the second roller handle (170) of the upper structure (100) facing each other. FIG. 4 shows a perspective view of the wire mesh dispenser (99), with a wire mesh roll (90) inserted within the upper structure (100) and the lower structure (200), showing the wire mesh (91) of the wire mesh roll (90) being guided through the gap (102) of the open shape segment (140) in the shape of a major arc.

Each of the roller handles (150) comprises of a vertical segment (151), an upper horizontal segment (154), a lower horizontal segment (155), a rotatable tube (158), an upper shaft (156) and a lower shaft (157). The vertical segment (15I) comprises of an upper end (152) and a lower end (153). The upper end (152) of the vertical segment (15I) is connected to the upper horizontal segment (154) and the upper shaft (156) is connected to the upper horizontal segment (154). The lower end (153) of the vertical segment (151) is connected to the lower horizontal segment (155) and the lower shaft (157) is connected to the lower horizontal segment (155). The rotatable tube (158) is inserted into the upper shaft (156) and the lower shaft (157). The rotatable tube (158) rotates around the upper shaft (156) and the lower shaft (157); this rolling motion allows for easier unrolling of the wire mesh (91) from the wire mesh dispenser (99) as the wire mesh (91) is pulled past and guided through the two roller handles (150)—the first roller handle (160) and the second roller handle (170) through the gap (120).

The first roller handle (160) comprises of a vertical segment (161), an upper horizontal segment (164), a lower horizontal segment (165), a rotatable tube (168), an upper shaft (166) and a lower shaft (167). The vertical segment (161) comprises of an upper end (162) and a lower end (163). The upper end (162) of the vertical segment (161) is connected to the upper horizontal segment (164) and the upper shaft (166) is connected to the upper horizontal segment (164). The lower end (163) of the vertical segment (161) is connected to the lower horizontal segment (165) and the lower shaft (167) is connected to the lower horizontal segment (165). The rotatable tube (168) is inserted into the upper shaft (166) and the lower shaft (167). The rotatable tube (168) rotates around the upper shaft (166) and the lower shaft (167); this rotational motion allows for easier unrolling of the wire mesh (91) from the wire mesh dispenser (99) as the wire mesh (91) is pulled past and guided through the first roller handle (160).

The second roller handle (170) comprises of a vertical segment (171), an upper horizontal segment (174), a lower horizontal segment (175), a rotatable tube (178), an upper shaft (176) and a lower shaft (177). The vertical segment (171) comprises of an upper end (172) and a lower end (173). The upper end (172) of the vertical segment (171) is connected to the upper horizontal segment (174) and the upper shaft (176) is connected to the upper horizontal segment (174). The lower end (173) of the vertical segment (171) is connected to the lower horizontal segment (175) and the lower shaft (177) is connected to the lower horizontal segment (175). The rotatable tube (178) is inserted into the upper shaft (176) and the lower shaft (177). The rotatable tube (178) rotates around the upper shaft (176) and the lower shaft (177); this rotational motion allows for easier unrolling of the wire mesh (10) from the wire mesh dispenser (99) as the wire mesh (91) is pulled past and guided through the second roller handle (170).

(2) Lower Structure (200)

Figure 2:
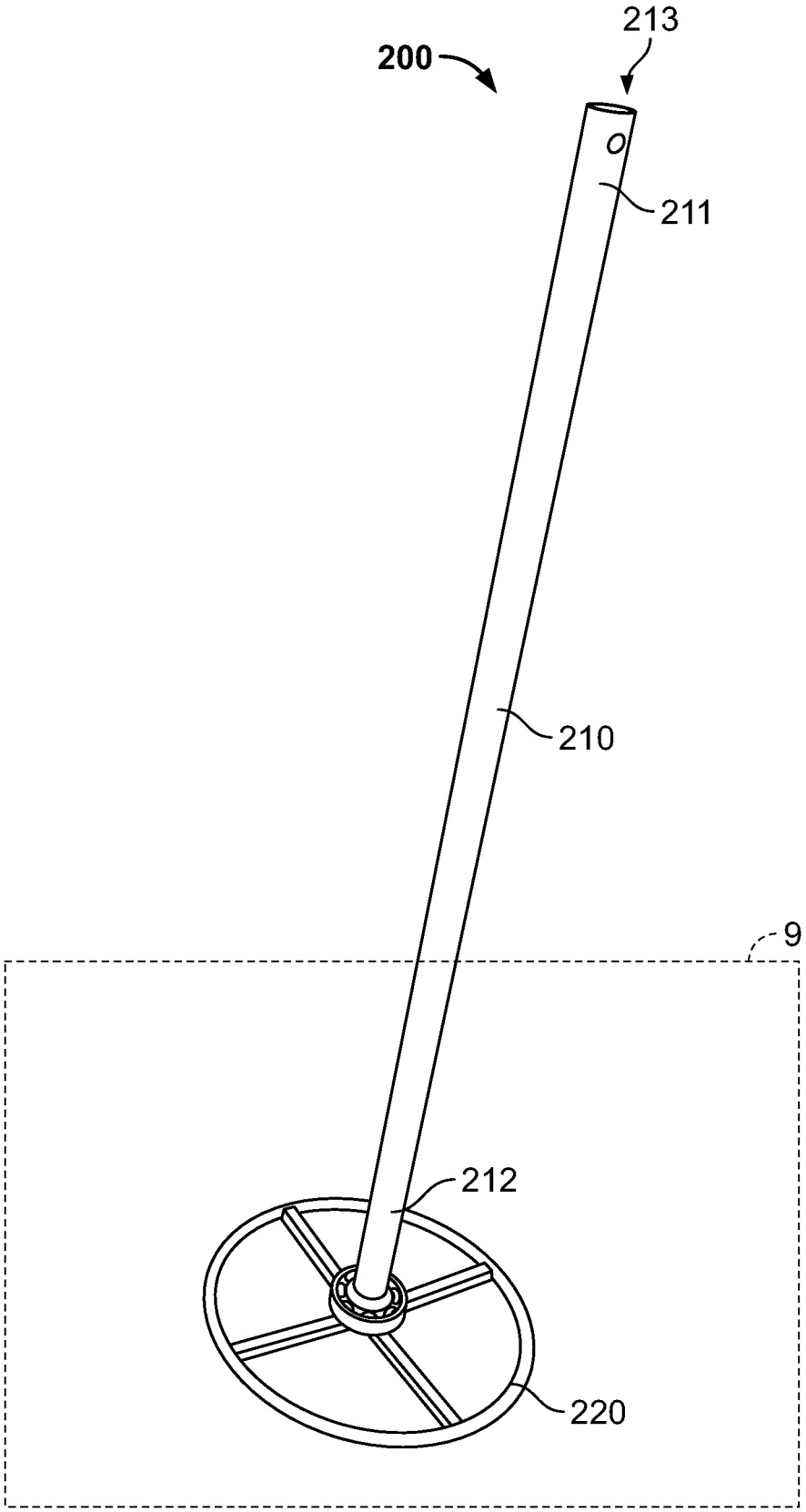
FIG. 2 shows a perspective view of the lower structure (200).

The lower structure (200) comprises of a lower shaft (210) and a base (220). The lower structure (200) supports the upper structure (100). When the lower structure (200) is fastened to the upper structure (100), they hold together the wire mesh roll (90). FIG. 2 shows a perspective view of the lower structure (200).

The lower shaft (210) is used to secure the lower end of the wire mesh roll (90). The lower shaft (210) comprises of an upper end (211), and a lower end (212). The lower shaft (210) can either be solid or be hollow. When the lower shaft (210) is hollow, the lower shaft (210) further comprises a bore (213).

The base (220) provides support for the lower shaft (210), the lower structure (200), and the wire mesh dispenser (99). The base (220) provides an area that supports the wire mesh roll (90). The shape of the base (220) is preferentially circular, mirroring the shape of the wire mesh roll (90). Other shapes can be used such as square, rectangular, and triangular.

As a first embodiment, the lower end (212) of the lower shaft (210) is connected to the base (220). When the wire mesh (91) is pulled from the wire mesh dispenser (99), the wire mesh roll (90) rotates around the fastened upper shaft (120) and lower shaft (210). The wire mesh roll (90) rotates over the base (220).

Figure 9:
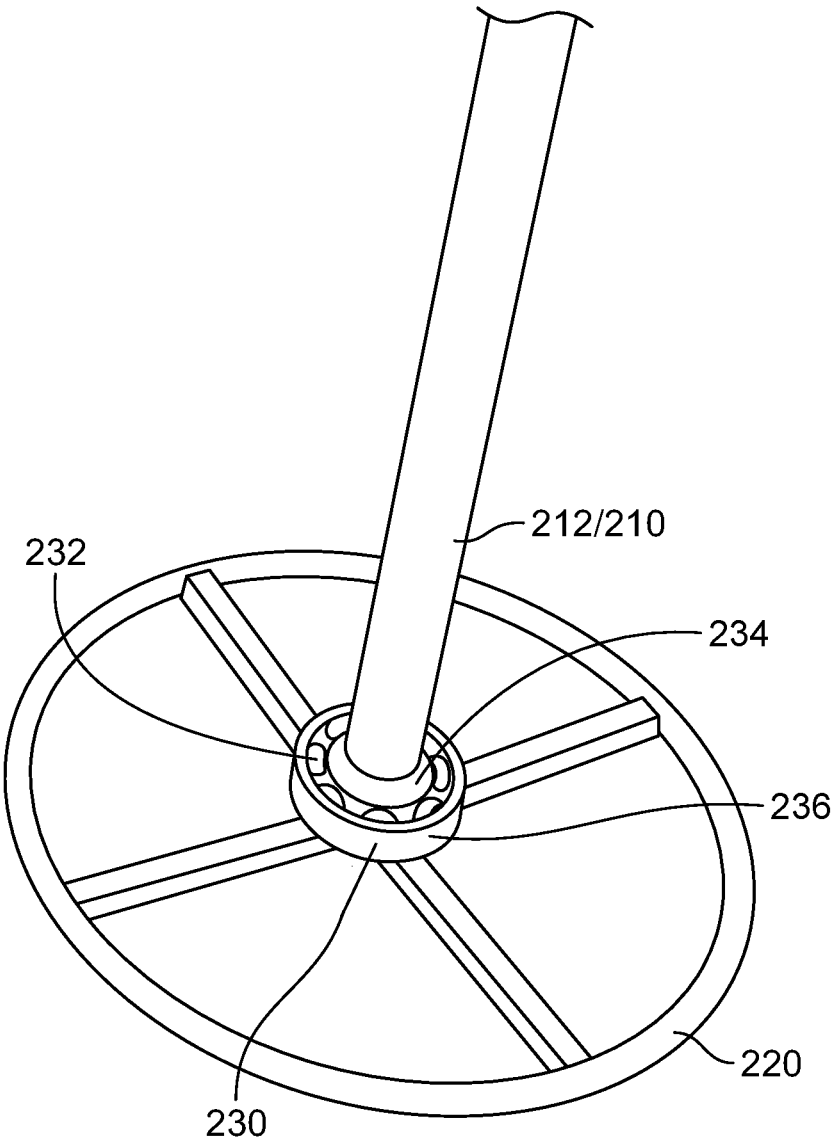
FIG. 9 is a close up perspective view of the lower structure (200) from FIG. 2. The lower end (212) of the lower shaft (210) is connected to the inner race (234) of the rolling-element bearing (230). The base (220) is connected to the outer race (236) of the rolling-element bearing (230).

As a second embodiment, a rolling-element bearing (230) is used to further enhance the rotation of the wire mesh roll (90). The rolling-element bearing (230) comprises of a plurality of rolling elements (232), an inner race (234), and an outer race (236). The rolling elements (232) lie between the inner race (234) and the outer race (236). The lower end (212) of the lower shaft (210) is connected to the inner race (234) of the rolling-element bearing (230). The base (220) is connected to the outer race (236) of the rolling-element bearing (230). The rolling-element bearing (230) allows the base (220) to rotate with the wire mesh roll (90) as the wire mesh (91) is pulled and the wire mesh roll (90) is unwound. This eliminates the friction caused by having the wire mesh roll (90) rotate over the base (220), since now the base (220) rotates with the wire mesh roll (90). The elimination of friction lowers the amount of force needed to pull the wire mesh (91) from the wire mesh dispenser (99). This allows a single individual to be better deploy the wire mesh (91). FIG. 9 is a close up perspective view of the lower structure (200) from FIG. 2. The lower end (212) of the lower shaft (210) is connected to the inner race (234) of the rolling-element bearing (230). The base (220) is connected to the outer race (236) of the rolling-element bearing (230).

Figure 10:
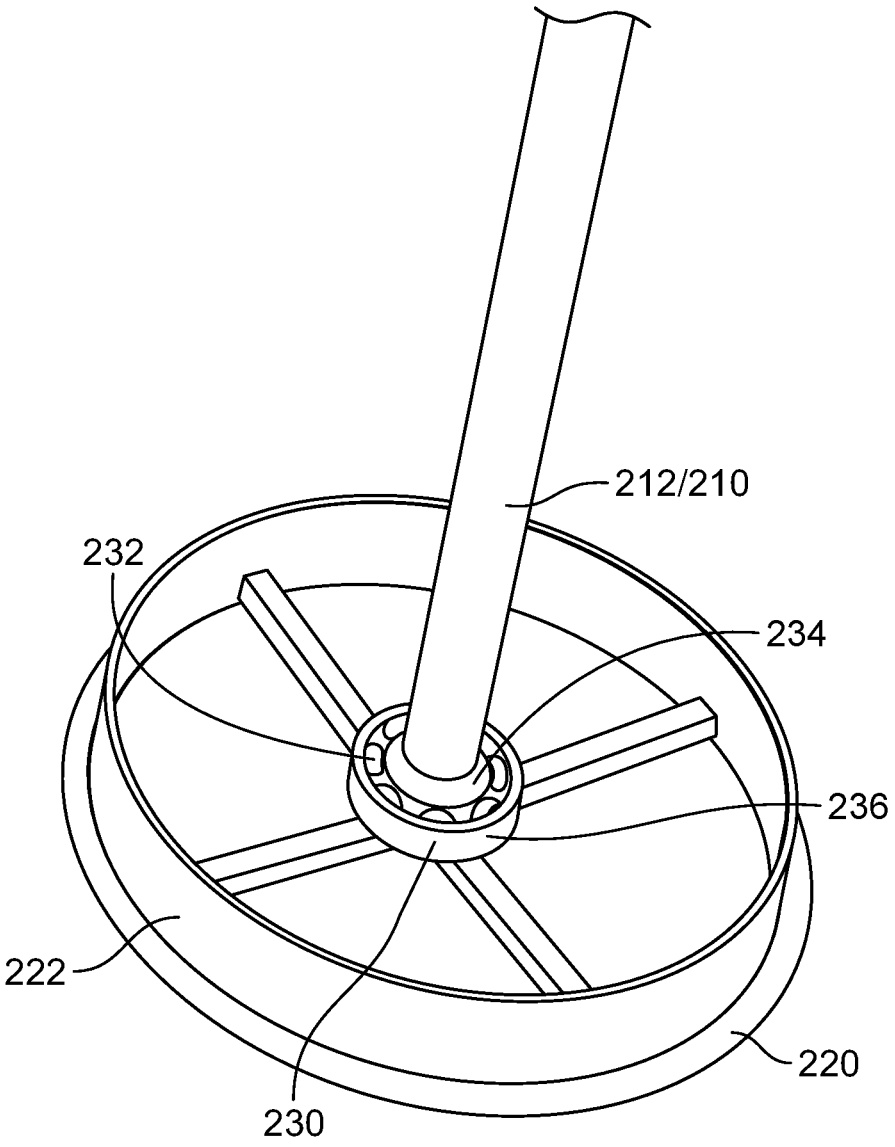
FIG. 10 is a close up perspective view of the lower structure (200) with a flange (222) connected to the perimeter of the base (220).

As a third embodiment, a flange (222) maybe connected to the base (220) and positioned around the perimeter of the base (220), creating a wall that prevents the wire mesh roll (90) from further unrolling when positioned inside the wire mesh dispenser (99). The flange (222) is preferentially oriented perpendicular to the base (220) and parallel to the lower shaft (210). This third embodiment can be used with the either mentioned first or second embodiments in this section (K)(2). FIG. 10 is a close up perspective view of the lower structure (200) with a flange (222) connected to the perimeter of the base (220).

(3) Means to Fasten Shafts (400)

The upper shaft (120) of upper structure (100) and lower shaft (210) of the lower structure (200) are fastened together by a means to fasten shafts (400). This means to fasten shafts (400) can be any state of art device that fastens together two shafts. These devices include but are not limited to pins (300), clamps, quick release clamps, shaft collars, splice locks and bolt & nut configurations. Examples of clamps that can be used as a means to fasten shafts (400) include but are not limited to T-bolt, V-band, barrel hardware, and worm gear clamps.

In some embodiments, both the upper shaft (120) and the lower shaft (210) are solid. The means to fasten shafts (400) shall be selected to allow for the fastening of two solid shafts.

In other embodiments, both the upper shaft (120) and the lower shaft (210) are hollow. The means to fasten shafts (400) shall be selected to allow for the fastening of two hollow shafts. The upper shaft (120) may fasten within the lower shaft (210), or alternatively, the lower shaft (210) may fasten within the upper shaft (120).

In further other embodiments, one of the shafts is hollow and the other shaft is solid. For example, the upper shaft (120) is hollow and the lower shaft (210) is solid. The means to fasten shafts (400) shall be selected to allow for the fastening of one hollow shaft and one solid shaft.

When at least one of the shafts is hollow, the upper shaft (120) and the lower shaft (210) may comprise threads so that one of the shafts can be screwed into the other shaft.

(3).1 Pin (300)

The means to fasten shafts (400) can be a pin (300). A pin (300) is one or more elements that secure the position of two or more parts relative to each other. Examples of pins include but are not limited to spring pins, button spring pins (310), quick release pins, split pins, and pin & clip configurations.

The pin (300) can fasten together the upper shaft (120) of upper structure (100) and lower shaft (210) of the lower structure (200). The pin (300) comprises of a first end (302) and a second end (304). A pin (300) normally can fasten together two hollow shafts or fasten together a hollow shaft and a solid shaft.

When a pin (300) is utilized to fasten together the upper shaft (120) of upper structure (100) and lower shaft (210) of the lower structure (200), the upper shaft (120) of the upper structure (100) further comprises two openings and the lower shaft (210) of the lower structure (200) further comprises two openings.

The upper shaft (120) of the upper structure (100) comprises of a first opening (124) and a second opening (126). The first opening (124) and the second opening (126) are located on the upper shaft (120) so that they face each other through the central axis of the upper shaft (120). This allows a pin (300) to be inserted through the first opening (124) and the second opening (126).

The lower shaft (210) of the lower structure (200) comprises of a first opening (214) and a second opening (216). The first opening (214) and the second opening (216) maybe located at the upper end (211) of the lower shaft (210). The first opening (214) and the second opening (216) are located on the lower shaft (210) so that they face each other through the central axis of the lower shaft (210). This allows a pin (300) to be inserted through the first opening (214) and the second opening (216).

One pin (300) is normally enough to fasten together the upper shaft (120) of upper structure (100) and lower shaft (210) of the lower structure (200). However, more that one pin can be utilized. In this instance, the upper shaft (120) further comprises additional corresponding first openings (124) and second openings (126) and the lower shaft (210) further comprises additional corresponding first openings (214) and second openings (216).

Figure 6:
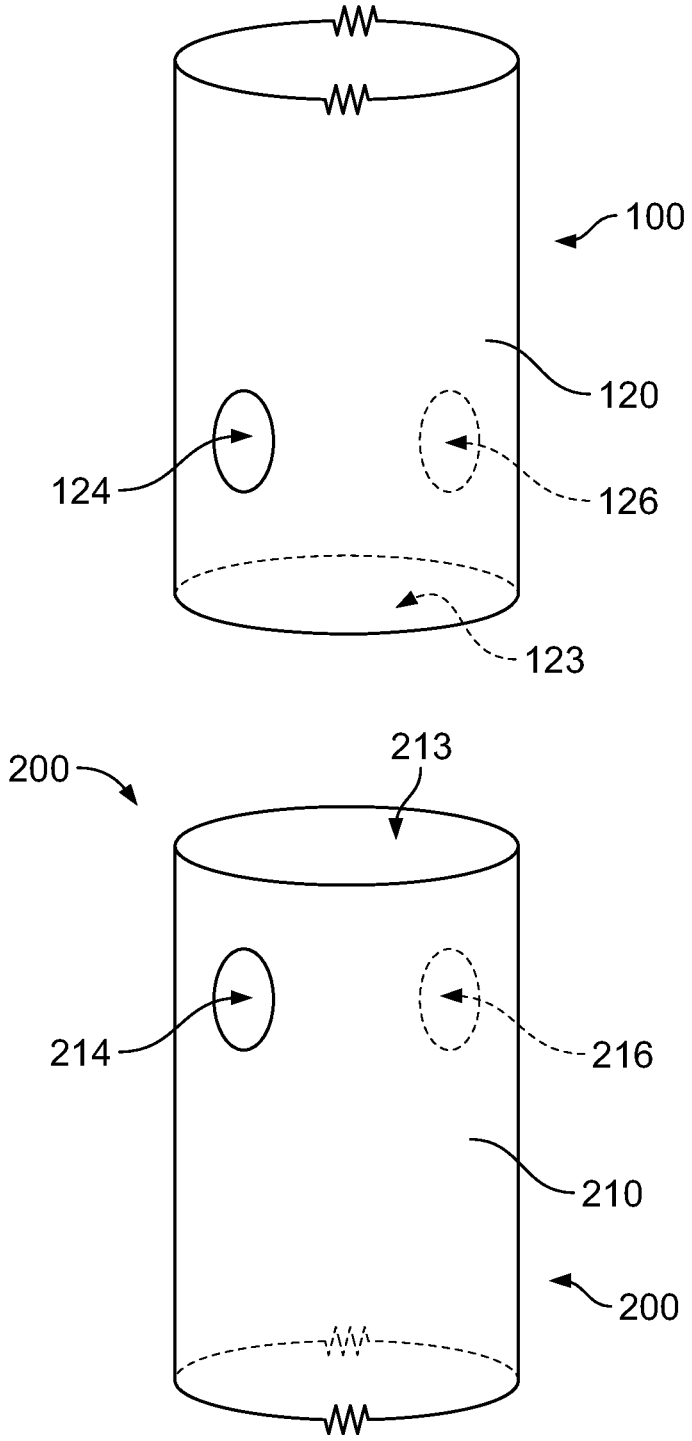
FIG. 6 shows an exploded view of the lower end (122) of upper shaft (120) of the upper structure (100) and the upper end (211) of the lower shaft (210) of the lower structure (200). The upper shaft (120) has a first opening (124) and a second opening (126); the lower shaft (210) has a first opening (214) and a second opening (216)

FIG. 6 shows an exploded view of the lower end (122) of upper shaft (120) of the upper structure (100) and the upper end (211) of the lower shaft (210) of the lower structure (200). The upper shaft (120) has a first opening (124) and a second opening (126); the lower shaft (210) has a first opening (214) and a second opening (216).

The upper shaft (120) and the lower shaft (210) are aligned so that the first opening (124) of the upper shaft (120) lines up with the first opening (214) of the lower shaft (210) and the second opening (216) of the upper shaft (120) lines up with the second opening (216) of the lower shaft (210). The pin (300) is inserted through the openings so that the first end (302) of the pin (300) lies within the first opening (124) of the upper shaft (120) and the first opening (214) of lower shaft (210), and the second end (304) of the pin lies within the second opening (126) of the upper shaft (120) and the second opening (216) of the lower shaft (210).

Figure 7:
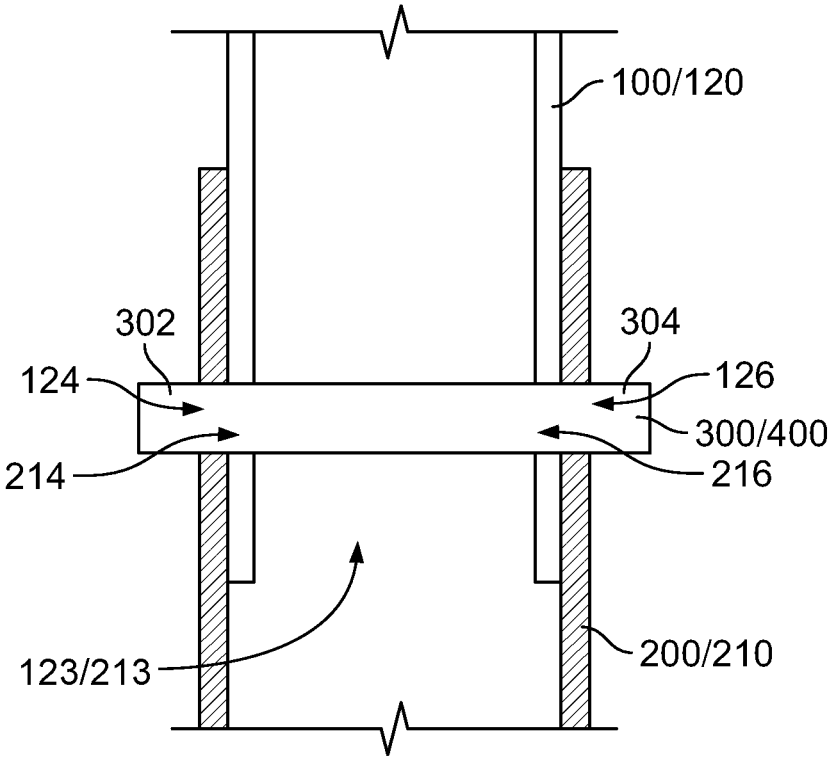
FIG. 7 shows a cross sectional view of the upper shaft (120) and lower shaft (210) fastened with a pin (300) inserted through the openings so that the first end (302) of the pin (300) lies within the first opening (124) of the upper shaft (120) and the first opening (214) of lower shaft (210), and the second end (304) of the pin (300) lies within the second opening (126) of the upper shaft (120) and the second opening (216) of the lower shaft (210)

FIG. 7 shows a cross sectional view of the upper shaft (120) and lower shaft (210) fastened with a pin (300) inserted through the openings so that the first end (302) of the pin (300) lies within the first opening (124) of the upper shaft (120) and the first opening (214) of lower shaft (210), and the second end (304) of the pin (300) lies within the second opening (126) of the upper shaft (120) and the second opening (216) of the lower shaft (210).

(3).2 Button Spring Pin (310)

A button spring pin (310) has two arms a left arm (312) and a right arm (316)—that are connected to each other. The left arm (312) has a left button (314) and the right arm (316) has a right button (318). A button spring pin (310) can be utilized when both the upper shaft (120) and lower shaft (210) are hollow. To fasten the shafts with a button spring pin (310), a user presses the left arm (312) and the right arm (316) towards each other, bending together the right button (318) and the left button (314). The right button (318) and the left button (314) are then inserted into one of the shafts and its corresponding first opening and second opening. This shaft is fastened to the other shaft and the right button (318) and the left button (314) being inserted to the corresponding first opening and second opening of the other shaft.

Figure 8:
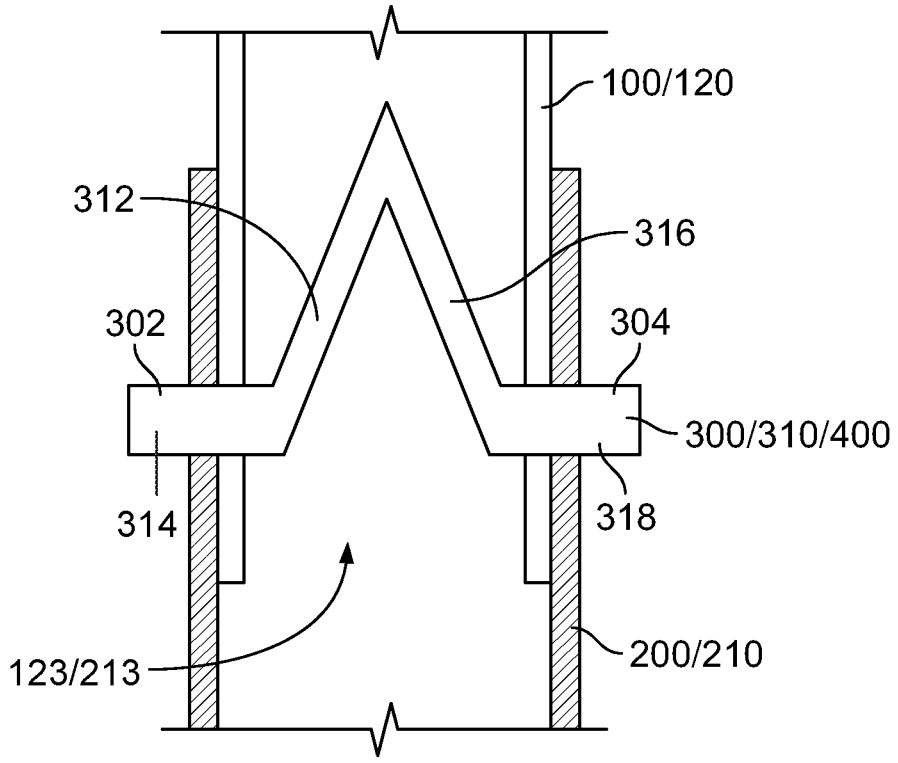
FIG. 8 shows a cross sectional view of the upper shaft (120) and lower shaft (210) fastened with a button spring pin (310) inserted through the openings so that the left button (314) of the button spring pin (310) lies within the first opening (124) of the upper shaft (120) and the first opening (214) of lower shaft (210), and the right button (318) of the button spring pin (310) lies within the second opening (126) of the upper shaft (120) and the second opening (216) of the lower shaft (210)

FIG. 8 shows a cross sectional view of the upper shaft (120) and lower shaft (210) fastened with a button spring pin (310) inserted through the openings so that the left button (314) of the button spring pin (310) lies within the first opening (124) of the upper shaft (120) and the first opening (214) of lower shaft (210), and the right button (318) of the button spring pin (310) lies within the second opening (126) of the upper shaft (120) and the second opening (216) of the lower shaft (210).

When pressed together, the right button (318) and the left button (314) move towards each other, releasing them from the openings and letting the upper shaft (120) and lower shaft (210) be unfastened from each other.

(4) Assembly and Usage

The user loads the wire mesh roll (90) to the wire mesh dispenser (99) by placing the lower hole (94) of the wire mesh roll (90) through the lower shaft (210) of the lower structure (200), so that the lower end of the wire mesh roll (90) lies over the base (220). The lower shaft (210) goes through the cylindrical central void (92) and can be accessed through the upper hole (93) of the wire mesh roll (90). The upper shaft (120) of the upper structure (100) is then fastened to the lower shaft (210) of the lower structure (200) by the means to fasten shafts (400). FIG. 4 shows a perspective view of the wire mesh dispenser (99), with a wire mesh roll (90) inserted within the upper structure (100) and the lower structure (200).

The wire mesh (91) from the wire mesh roll (90) is pulled between the first roller handle (160) and the second roller handle (170) through the gap (102). As the wire mesh (91) is pulled, the wire mesh roll (90) rotates around the fastened upper shaft (120) and lower shaft (210) within the wire mesh dispenser (99). The rotation of the rotatable tube (168) from the first roller handle (160) and the rotation of the rotatable tube (178) from the second roller handle (170) help with the deployment of the wire mesh (91). The rotation of the wire mesh roll (90) maybe further enhanced if a rolling-element bearing (230) is connected between the lower end (212) of the lower shaft (210) and the base (220), as described above in Section (K)(2). Due to the rolling-element bearing (230), the base (220) rotates as the wire mesh (91) from the wire mesh roll (90) is pulled.

A user may deploy wire mesh (91) by securing the wire mesh (91) from the wire mesh roll (90) to a structure, creating an anchor point. Once the anchor point is created, the user moves the wire mesh dispenser (99) along the structure, allowing the wire mesh roll (90) to unroll. This technique allows an individual to cover structures with wire mesh (91) in an efficient manner, without the aid of other devices or other individuals.

A user may also deploy wire mesh (91) by securing the wire mesh dispenser (99) in place e.g. ground, wall, pole and pulling out the wire mesh (91) from the wire mesh roll (90). These two techniques provides for flexibility in deploying wire mesh (91).

(5) Clarifying Comments

While the foregoing written description of the invention enables a person having ordinary skill in the art to make and use what is considered presently to be the best mode thereof, those of ordinary skill in the art will understand and appreciate the existence of variations, combinations, and equivalents of the specific embodiment, process, and examples herein. The invention should therefore not be limited by the above described embodiment, process, and examples, but by all embodiments and processes within the scope and spirit of the invention.

SEQUENCE LISTING

Not Applicable

I claim:

1. A wire mesh dispenser that deploys wire mesh from a wire mesh roll, comprising of (a) An upper structure, the upper structure comprising of:
- (i) an upper structure handle;
- (ii) a horizontal segment; the horizontal segment comprising of:
  - (1) a first end;
  - (2) a second end;
- (iii) a first vertical segment;
- (iv) a second vertical segment;
- (v) an upper shaft, the upper shaft comprising of:
  - (1) an upper end;
  - (2) a lower end;
- (vi) an open shape segment; the open shape segment comprising of:
  - (1) a first end;
  - (2) a second end;
- (vii) a first and a second roller handles, each roller handle comprising of:
  - (1) a vertical segment; the vertical segment comprising of:
    - (a) an upper end;
    - (b) a lower end;
  - (2) an upper horizontal segment;
  - (3) a lower horizontal segment;
  - (4) a rotatable tube;
  - (5) an upper shaft;
  - (6) a lower shaft;
  - (7) where the upper end of the vertical segment of the roller handle is connected to the upper horizontal segment of the roller handle,
  - (8) where the upper shaft of the roller handle is connected to the upper horizontal segment of the roller handle, (9) where the lower end of the vertical segment of the roller handle is connected to the lower horizontal segment of the roller handle,

(10) where the lower shaft of the roller handle is connected to the lower horizontal segment of the roller handle,

(11) where the rotatable tube is inserted into the upper shaft of the roller handle and the lower shaft of the roller handle, (viii) where the first vertical segment of the upper structure is connected to the first end of the horizontal segment of the upper structure, (ix) where the second vertical segment of the upper structure is connected to the second end of the horizontal segment of the upper structure, (x) where the upper end of the upper shaft of the upper structure is connected to the horizontal segment of the upper structure, (xi) where the upper structure handle is connected to the horizontal segment of the upper structure, (xii) where the open shape segment is connected to the first vertical segment of the upper structure and to the second vertical segment of the upper structure, (xiii) where the vertical segment of the first roller handle is connected to the first end of the open shape segment;

(xiv) where the vertical segment of the second roller handle is connected to the second end of the open shape segment, (b) a lower structure, the lower structure comprising of:

(i) a lower shaft, the lower shaft comprising of:

(1) an upper end;

(2) a lower end;

(ii) a base;

(iii) where the lower end of the lower shaft of the lower structure is connected to the base, (c) a means to fasten shafts;

(d) where the means to fasten shafts fastens the upper shaft of the upper structure to the lower shaft of the lower structure, (e) where the wire mesh from the wire mesh roll is guided through the rotatable tube of the first roller handle and the rotatable tube of the second roller handle.

2. The wire mesh dispenser as defined in claim 1, (a) wherein the means to fasten shaft is a pin, the pin comprising of:

(i) a first end:

(ii) a second end;

(b) wherein the lower shaft of the lower structure further comprising:

(i) a first opening;

(ii) a second opening;

(iii) where the first opening of the lower shaft and second opening of the lower shaft are aligned so that they face each other though the center of the lower shaft of the lower structure, (c) wherein the upper shaft of the upper structure further comprising:

(i) a first opening;

(ii) a second opening;

(iii) where the first opening of the upper shaft and second opening of the upper shaft are aligned so that they face each other though the axis of symmetry of the upper shaft of the upper structure, (d) where the first end of the pin is placed through the first opening of the upper shaft and the first opening of the lower shaft, (e) where the second end of the pin is placed through the second opening of the upper shaft and the second opening of the lower shaft.

3. The wire mesh dispenser as defined in claim 1, (a) wherein the means to fasten shafts is a button spring pin, the button spring pin comprising of:

(i) a left arm, the left arm comprising of a left button;

(ii) a right arm, the right arm comprising of a right button;

(iii) where the left arm and right arm are connected to each other, (b) wherein the lower shaft of the lower structure further comprising:

(i) a first opening;

(ii) a second opening;

(iii) where the first opening of the lower shaft and the second opening of the lower shaft are aligned so that they face each other though the center of the lower shaft of the lower structure, (c) wherein the upper shaft of the upper structure further comprising:

(i) a first opening;

(ii) a second opening;

(iii) where the first opening of the upper shaft and the second opening of the upper shaft are aligned so that they face each other though the axis of symmetry of the upper shaft of the upper structure, (d) wherein the lower structure, the lower shaft is hollow, (e) wherein the upper structure, the upper shaft is hollow, (f) where the left button of the spring button pin is placed through the first opening of the upper shaft and the first opening of the lower shaft, (g) where the right button of the spring button pin is placed through the second opening of the upper shaft and the second opening of the lower shaft.

4. The wire mesh dispenser as defined in claim 1, (a) wherein the base further comprising a flange, (b) where the flange is connected to the perimeter of the base, (c) where the flange keeps the wire mesh roll from unrolling.

5. The wire mesh dispenser as defined in claim 1, (a) where the open shape segment has a major arc shape.

6. The wire mesh dispenser as defined in claim 1, (a) wherein the lower structure further comprising a rolling-element bearing, the rolling-element bearing comprising of:

(i) a plurality of rolling elements;

(ii) an inner race;

(iii) an outer race;

(b) where the lower end of the lower shaft is connected to the inner race of the rolling-element bearing, (c) where the base is connected to the outer race of the rolling-element bearing, (d) where the base rotates around the lower end of the lower shaft.

7. The wire mesh dispenser as defined in claim 6, (a) wherein the base further comprising a flange, (b) where the flange is connected to the perimeter of the base, (c) where the flange keeps the wire mesh roll from unrolling.

8. The wire mesh dispenser as defined in claim 6, (a) where the open shape segment has a major arc shape.

9. The wire mesh dispenser as defined in claim 2,
(a) wherein the base further comprising a flange,
(b) where the flange is connected to the perimeter of the base,
(c) where the flange keeps the wire mesh roll from unrolling.

10. The wire mesh dispenser as defined in claim 2,
(a) where the open shape segment has a major arc shape.

11. The wire mesh dispenser as defined in claim 2,
(a) wherein the lower structure further comprising a rolling-element bearing, the rolling-element bearing comprising of:
(i) a plurality of rolling elements;
(ii) an inner race;
(iii) an outer race;
(b) where the lower end of the lower shaft is connected to the inner race of the rolling-element bearing,
(c) where the base is connected to the outer race of the rolling-element bearing,
(d) where the base rotates around the lower end of the lower shaft.

12. The wire mesh dispenser as defined in claim 11,
(a) wherein the base further comprising a flange,
(b) where the flange is connected to the perimeter of the base,
(c) where the flange keeps the wire mesh roll from unrolling.

13. The wire mesh dispenser as defined in claim 11,
(a) where the open shape segment has a major arc shape.

14. The wire mesh dispenser as defined in claim 3,
(a) wherein the base further comprising a flange,
(b) where the flange is connected to the perimeter of the base,
(c) where the flange keeps the wire mesh roll from unrolling.

15. The wire mesh dispenser as defined in claim 3,
(a) where the open shape segment has a major arc shape.

16. The wire mesh dispenser as defined in claim 3,
(a) wherein the lower structure further comprising a rolling-element bearing, the rolling-element bearing comprising of:
(i) a plurality of rolling elements;
(ii) an inner race;
(iii) an outer race;
(b) where the lower end of the lower shaft is connected to the inner race of the rolling-element bearing,
(c) where the base is connected to the outer race of the rolling-element bearing,
(d) where the base rotates around the lower end of the lower shaft.

17. The wire mesh dispenser as defined in claim 16,
(a) wherein the base further comprising a flange,
(b) where the flange is connected to the perimeter of the base,
(c) where the flange keeps the wire mesh roll from unrolling.

18. The wire mesh dispenser as defined in claim 16,
(a) where the open shape segment has a major arc shape.

* * * * *